US009881600B1

(12) United States Patent
Shetye et al.

(10) Patent No.: US 9,881,600 B1
(45) Date of Patent: Jan. 30, 2018

(54) ACOUSTICALLY OPEN HEADPHONE WITH ACTIVE NOISE REDUCTION

(71) Applicant: Bose Corporation, Framington, MA (US)

(72) Inventors: Mihir D. Shetye, Framington, MA (US); Ole Mattis Nielsen, Waltham, MA (US); Ryan C. Silvestri, Franklin, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/223,634

(22) Filed: Jul. 29, 2016

(51) Int. Cl.
*G10K 11/178* (2006.01)
*H04R 1/10* (2006.01)

(52) U.S. Cl.
CPC ..... *G10K 11/178* (2013.01); *H04R 1/1083* (2013.01); *G10K 2210/1081* (2013.01); *G10K 2210/3027* (2013.01); *H04R 2460/11* (2013.01)

(58) Field of Classification Search
CPC .... H04R 5/033; H04R 1/1041; H04R 1/1083; H04R 1/10; H04R 2201/107; H04R 2420/01; H04R 5/027; H04R 1/1066; H04R 2420/09; H04R 2430/01; H04R 2460/01; H04M 1/05; H04M 1/6066; G10K 11/178
See application file for complete search history.

(56) References Cited

U.S. PATENT DOCUMENTS 4,489,441 A 12/1984 Chaplin
5,559,893 A 9/1996 Krokstad et al.
6,078,672 A 6/2000 Saunders et al.
8,184,822 B2 5/2012 Carreras et al.
8,280,063 B2 10/2012 Schmidt
8,416,960 B2 4/2013 D'Agostino et al.
8,472,636 B2 6/2013 Sibbald
8,571,228 B2 10/2013 Sapiejewski et al.
2002/0012441 A1* 1/2002 Matsunaga ..... A42B 1/245 381/381
2004/0105566 A1* 6/2004 Matsunaga ..... A42B 1/245 381/381

(Continued)

FOREIGN PATENT DOCUMENTS

EP 0583900 A1 2/1994
EP 1979892 A1 10/2008

(Continued)

OTHER PUBLICATIONS

Imamura, Yazz—Vie Shair "The world's first full open air smart heaadphone", Brochure—2016.

(Continued)

*Primary Examiner* — Mohammad Islam

(57) ABSTRACT

A headphone includes an electroacoustic transducer and a support structure for suspending the transducer adjacent to a user's ear when worn by the user such that the headphone is acoustically open. A first microphone is coupled to one or more of the transducer and the support structure such that the first microphone is located in a substantially broadband acoustic null of the transducer. A processor is coupled to the headphone. The microphone receives sound pressure waves and outputs a related electronic signal to the processor. The processor uses the electronic signal to operate the transducer to reduce targeted sound pressure waves at the user's ear.

20 Claims, 5 Drawing Sheets

(56) References Cited

U.S. PATENT DOCUMENTS

2006/0176660 A1* 8/2006 Amiri ..... G06F 1/1615 361/679.09
2006/0198543 A1* 9/2006 Vaerum ..... H04R 1/105 381/375
2009/0097681 A1* 4/2009 Puria ..... H04R 25/405 381/318
2010/0183182 A1* 7/2010 Grandt ..... A42B 3/166 381/367
2011/0044464 A1 2/2011 Sapiejewski et al.
2011/0044465 A1* 2/2011 D'Agostino ..... G10K 11/178 381/71.6
2011/0103609 A1* 5/2011 Pelland ..... H04M 1/0254 381/74
2011/0129107 A1* 6/2011 Andersen ..... H04R 1/083 381/317
2011/0142247 A1* 6/2011 Fellers ..... G10K 11/178 381/71.1
2012/0057720 A1* 3/2012 Van Leest ..... G10K 11/1782 381/71.11
2012/0250873 A1 10/2012 Bakalos et al.
2013/0142351 A1* 6/2013 Andersen ..... H04R 1/10 381/74
2013/0156248 A1* 6/2013 Nakajima ..... H04R 1/1091 381/374
2013/0243225 A1 9/2013 Yokota
2014/0126734 A1* 5/2014 Gauger, Jr. ..... H04R 3/002 381/71.6
2014/0126736 A1* 5/2014 Gauger, Jr. ..... G10K 11/178 381/71.6
2014/0126756 A1* 5/2014 Gauger, Jr. ..... A61F 11/14 381/309
2015/0154950 A1 6/2015 Ring

FOREIGN PATENT DOCUMENTS

EP 2830324 A1 1/2015
JP 2014147023 A 8/2014

OTHER PUBLICATIONS

Vie Shair Website—http://www.vie.style/#main ; Date accessed: Jul. 29, 2016.
Unpublished U.S. Appl. No. 14/993,443, filed Jan. 12, 2016.
Unpublished U.S. Appl. No. 14/993,607, filed Jan. 12, 2016.
Indiegogo Website—https://www.indiegogo.com/projects/vie-shair-the-pain-free-sociable-headphone-sound-audio#/ ; Date accessed: Jul. 29, 2016.
International Search Report and Written Opinion dated Sep. 26, 2017 for International Application No. PCT/US2017/042942.

* cited by examiner

ACOUSTICALLY OPEN HEADPHONE WITH ACTIVE NOISE REDUCTION

CROSS REFERENCE TO RELATED APPLICATIONS

This application may be related to pending U.S. patent application Ser. Nos. 14/993,443 and 14/993,607, both filed on Jan. 12, 2016

BACKGROUND

Headphones are typically located in, on or over the ears. One result is that outside sound is occluded. This has an effect on the wearer's ability to participate in conversations as well as the wearer's environmental/situational awareness. It is thus desirable at least in some situations to allow outside sounds to reach the ears of a person using headphones.

Headphones can be designed to sit off the ears so as to allow outside sounds to reach the wearer's ears. This type of headphone is sometimes referred to as an open headphone. Two benefits of an open headphone are situational awareness and being un-occluded.

The value of these benefits diminishes as the external environment starts getting noisier and the user is not able to enjoy the audio that they are listening to. In noisy environments above, for example, 70 dBA (especially babble), the open headphone experience deteriorates rapidly. It is in these environments that the open headphone can benefit from active noise reduction (ANR).

SUMMARY

In general, in one aspect, a headphone includes an electroacoustic transducer and a support structure for suspending the transducer adjacent to a user's ear when worn by the user such that the headphone is acoustically open. A first microphone is coupled to one or more of the transducer and the support structure such that the first microphone is located in a substantially broadband acoustic null of the transducer. A processor is coupled to the headphone. The microphone receives sound pressure waves and outputs a related electronic signal to the processor. The processor uses the electronic signal to operate the transducer to reduce targeted sound pressure waves at the user's ear.

Implementations may include one or more of the following, in any combination. A second microphone is coupled to one or more of the transducer and the support structure. The second microphone is a feedback microphone located between the transducer and the user's ear. The second microphone receives sound pressure waves and outputs a related electronic signal to the processor. The processor uses these electronic signal to operate the transducer to reduce targeted sound pressure waves at the user's ear. The first microphone is located substantially at a periphery of a basket of the transducer. The headphone further includes one or more additional microphones which are also coupled to one or more of the transducer and the support structure such that the one or more additional microphones are also located in a substantially broadband acoustic null of the transducer. The one or more additional microphones receive sound pressure waves and output a related electronic signals to the processor. The processor uses these electronic signals to operate the transducer to reduce targeted sound pressure waves at the user's ear. The processor discontinues using the electronic signal to operate the transducer to reduce targeted sound pressure waves at the user's ear when a noise level in a vicinity of the headphone drops below a certain level. Acoustic impedances at a rear and front of the electroacoustic transducer are substantially the same. The headphone further includes a pair of baskets which surround a diaphragm of the electroacoustic transducer. Each basket has one or more openings such that acoustic impedances at a rear and front of the electroacoustic transducer are substantially the same.

In general, in another aspect, a headphone includes an electroacoustic transducer and a support structure for suspending the transducer adjacent to a user's ear when worn by the user such that the headphone is acoustically open. A first microphone is coupled to one or more of the transducer and the support structure. A processor is coupled to the headphone. The microphone receives sound pressure waves and outputs a related electronic signal to the processor. The processor uses the electronic signal to operate the transducer to reduce targeted sound pressure waves at the user's ear.

Implementations may include one or more of the above and below features, in any combination. The first microphone is a feed-forward microphone.

In general, in another aspect, an apparatus for creating sound includes an electroacoustic transducer and a first microphone coupled to the transducer such that the first microphone is located in a substantially broadband acoustic null of the transducer. A processor is coupled to the microphone. The microphone receives sound pressure waves and outputs a related electronic signal to the processor. The processor uses the electronic signal to operate the transducer to reduce targeted sound pressure waves at a user's ear.

Implementations may include one or more of the above and below features, in any combination. Acoustic impedances at a rear and front of the electroacoustic transducer are substantially the same.

All examples and features mentioned above can be combined in any technically possible way. Other features and advantages will be apparent from the description and the claims.

DESCRIPTION

The description below discloses open headphones that sit off the ears so as to allow outside sounds to reach the wearer's ears. One or more microphones are used to sense noise in an environment near the headphones. Microphone signals are then used by a processor to operate an electroacoustic transducer of the headphones to reduce noise that is heard by a headphone user. As such, even in noisy environments the user is able to more clearly hear the audio program they are listening to through their headphones. The ANR has an equivalent effect of turning the audio volume up and can make the headphone more suitable in noisy environments higher than 70 dBA.

Figure 1:
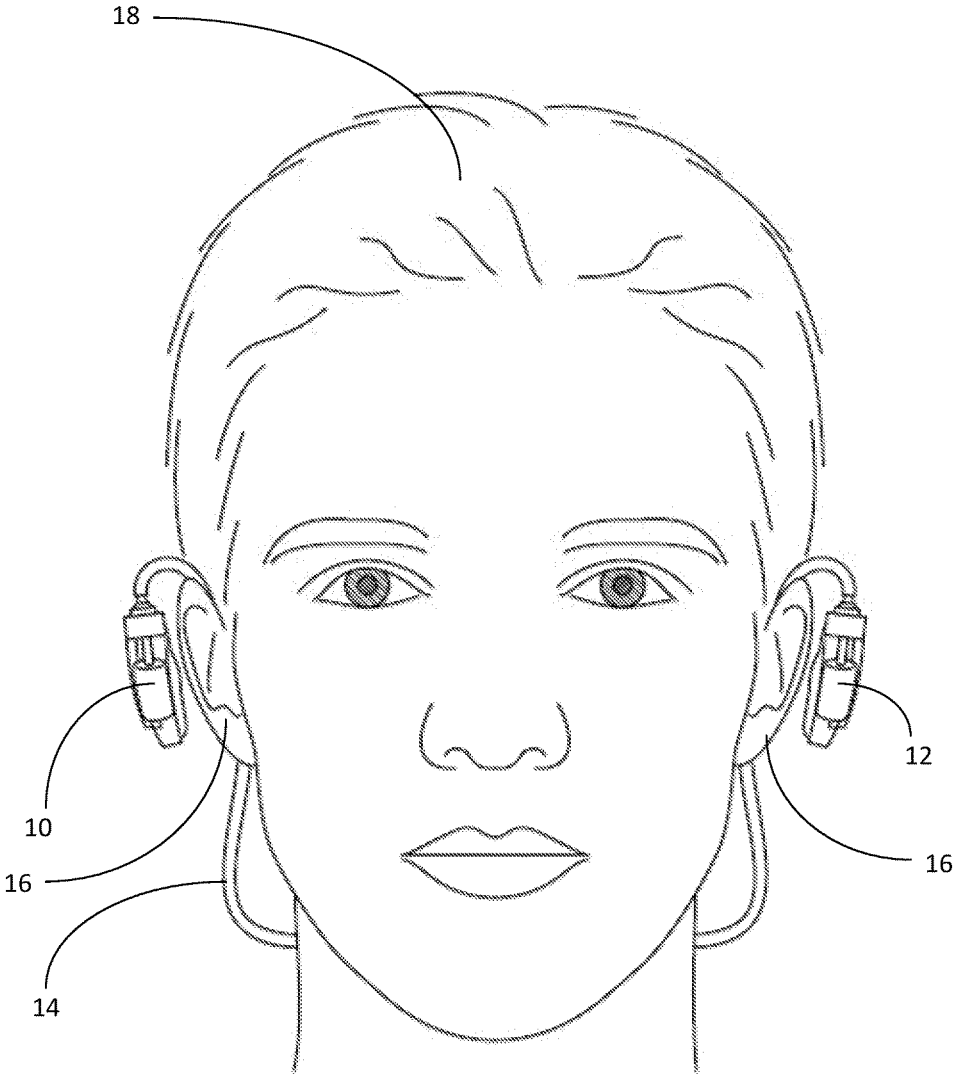
FIG. 1 shows a front view of a person wearing a pair of headphones.

Referring to FIG. 1, a pair of headphones 10, 12 each include an electroacoustic transducer (discussed in more detail below). The headphones are each connected to a support structure 14 for suspending the respective transducers adjacent to a user's ears 16 when worn by the user 18. As such, the headphone is acoustically open which means that a headphone only minimally passively interferes with the user hearing sounds in their environment. This helps to maintain completely natural self-voice (the user's voice sounds natural to themselves) as well as situational awareness.

In this example the support structure 14 is in the form of a nape band which rests on a nape of the neck of the user 18. The support structure 14 also loops over and rests above the pinna of each of the user's ears and then extends to support each headphone 10, 12 in a position slightly spaced from a respective ear of the user. This arrangement provides comfort while the user is wearing the headphones. Alternatively, the support structure could be a more traditional headband which extends across the top and sides of a user's head.

Figure 2A:
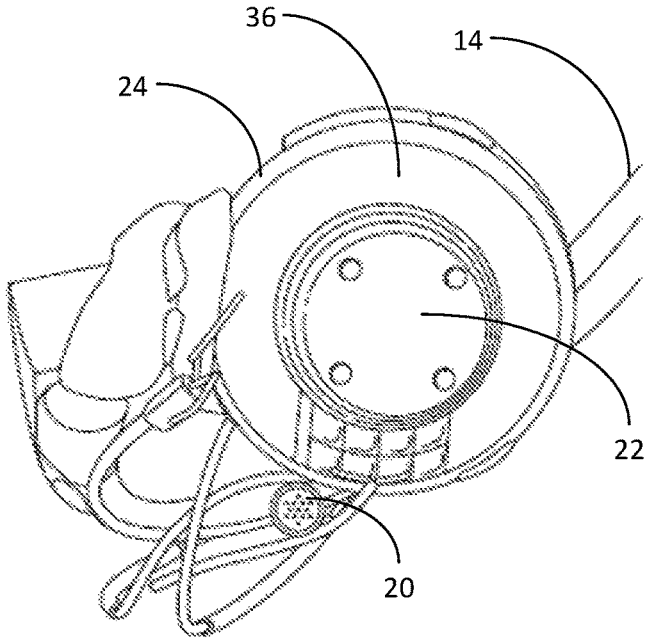
FIG. 2A is a side view of one of the headphones of FIG. 1 which faces away from a user's ear.

Turning to FIG. 2A, a first microphone 20 is coupled to an electroacoustic transducer 22. In this example the microphone 20 is a feed forward microphone which is connected to and located substantially at a periphery of a rear basket 24 of the transducer 22. Alternatively or additionally, the microphone 20 can be connected to a portion of the support structure 14. It is preferable that that the microphone 20 is located in a substantially broadband acoustic null of the transducer 22. This means that the transducer 22 is located where the acoustic energy coming off of both sides of a moving diaphragm (discussed further below) substantially cancels each other out across a broad frequency band. The low frequency bandwidth limitation comes from the ability of the transducer to cancel noise (e.g. about 50 Hz). The high frequency feed forward bandwidth is governed by the bandwidth of the null (in FIG. 6 this is about 4 kHz). So in this example the broadband acoustic null ranges from about 50-4000 Hz. One or more additional feed forward microphones (not shown) can be coupled to one or more of the transducer 22 and the support structure 14 such that the one or more additional microphones are also located in a substantially broadband acoustic null of the transducer.

Figure 2B:
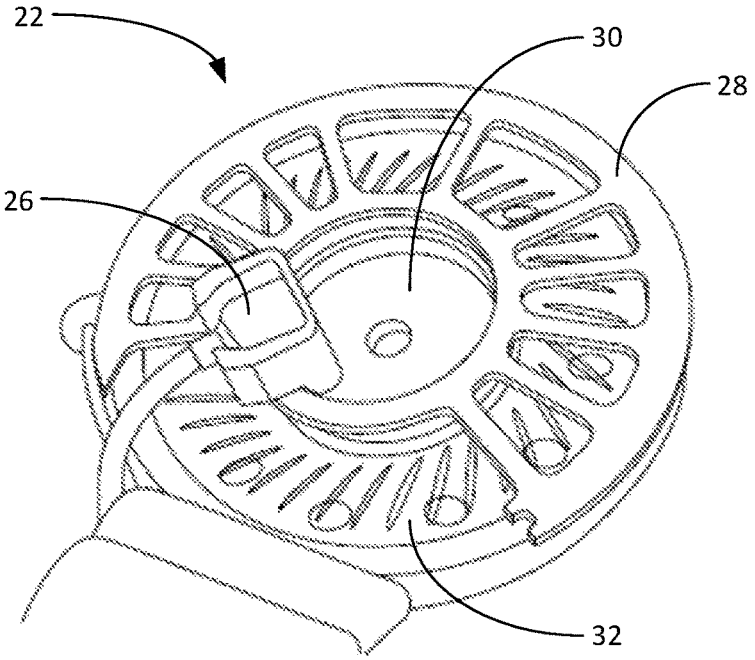
FIG. 2B is a perspective view of the other side of the one headphone from FIG. 1 which faces towards a user's ear.

With reference to FIG. 2B, a second microphone 26 is coupled to a front basket 28 of the transducer 22. In this example the microphone 26 is a feedback microphone. Alternatively or additionally, the microphone 26 can be connected to a portion of the support structure 14. The microphone 26 is located between the transducer and the user's ear. Also visible are a diaphragm 30 and a surround 32 of the transducer 22. The surround 32 is a suspension which allows the diaphragm 30 to vibrate in order to create sound waves.

Figure 3:
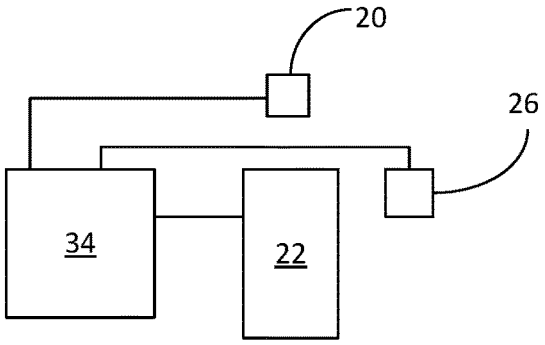
FIG. 3 is a block diagram of a processor, two microphones, and an electroacoustic transducer.

Turning to FIG. 3, a processor 34 is electrically connected with the microphones 20 and 26, and with the transducer 22. The microphone 20, being in a broadband acoustic null of the transducer 22, picks up sound pressure waves in the vicinity of the headphone that are entirely or mostly not created by the transducer 22. The microphone 20 outputs an electronic signal to the processor 34 which is related to the sound pressure waves that are picked up (i.e. environmental noise).

The microphone 26 also picks up sound pressure waves in the vicinity of the headphone but also picks up sound pressure waves created by the transducer 22. The microphone 26 outputs an electronic signal to the processor 34 which is related to the sound pressure waves that are picked up. The processor 34 subtracts an electronic signal used to drive the transducer 22 from the signal sent by microphone 26. The resulting signal represents environmental noise in the vicinity of the headphone. The processor 34 uses the electronic signals from the microphones 20 and 26 to operate the transducer 22 to reduce targeted sound pressure waves at the user's ear. This is known to those skilled in the art as an active noise reduction system. The processor uses the signals of microphones 20 and 26 as is known to those skilled in the art (see, for example U.S. Pat. Nos. 8,184,822 and 8,416,960).

When a signal from one or both of the microphones 20 and 26 indicates to the processor 34 that a noise level in a vicinity of the headphone has dropped below a certain level (e.g. about 65 dBA), the processor discontinues using the electronic signals from the microphone(s) to operate the transducer 22 to reduce targeted sound pressure waves at the user's ear. In essence, when the environment around the user is relatively quiet, it makes sense to shut off the active noise reduction system in order to conserve battery power.

Figure 4:
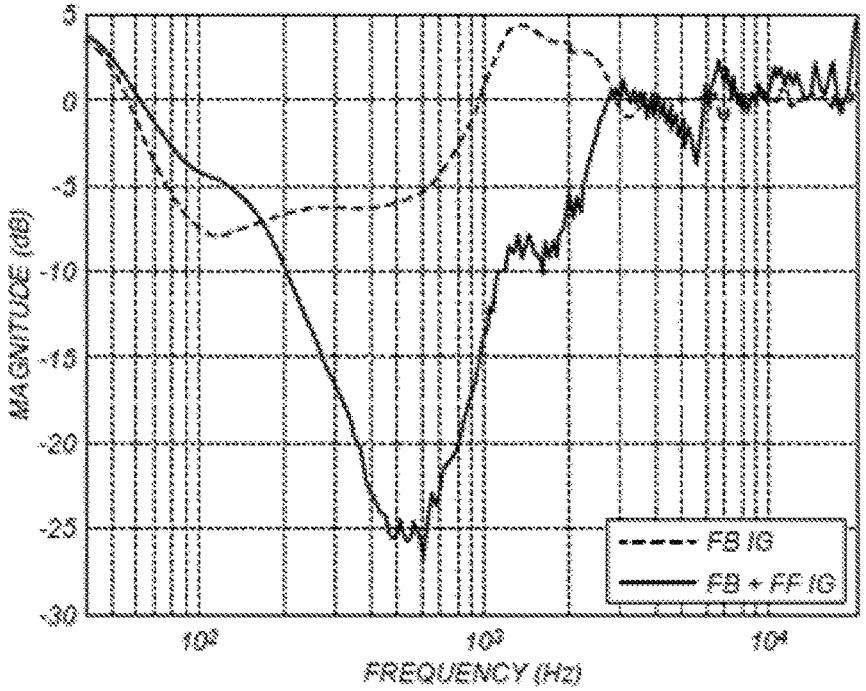
FIG. 4 is a graph showing the magnitude of ANR relative to frequency.

Referring to FIG. 4, a graph shows the magnitude of noise reduction in dB relative to frequency for the nape-band style open headphone of FIG. 1 as measured on a single human head. The dotted line shows the noise reduction using the feedback microphone 26 only. The solid line shows the noise reduction using both the feed forward microphone 20 and the feedback microphone 26. This graph shows that the active noise reduction system is effective in the mid-high frequency region. If the dotted line is subtracted from the solid line, what remains is the noise reduction using the feed forward microphone 20 only. In this case, the noise reduction is >10 dB from about 300 Hz to about 2 kHz.

Figure 5:
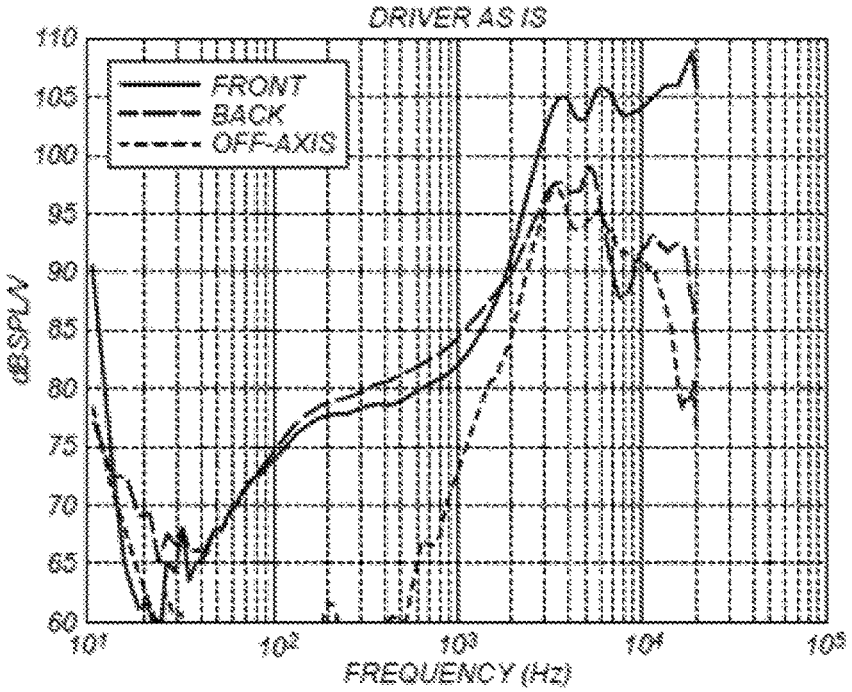
FIG. 5 is a graph showing the dipole behavior for an electroacoustic driver with mesh over the back basket.
Figure 6:
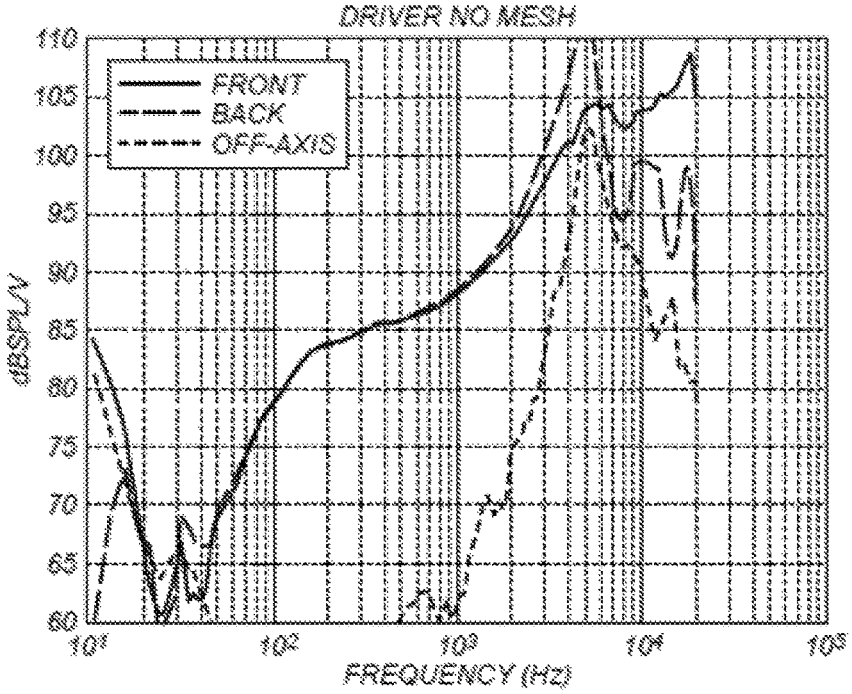
FIG. 6 is a graph showing the dipole behavior for an electroacoustic driver with mesh removed from the back basket.

Turning to FIGS. 5 and 6, graphs are shown of the dipole behavior of the transducer 22 with (FIG. 5) and without (FIG. 6) a cloth mesh 36 (FIG. 2A) on a rear basket 24 of the transducer 22. The dipole behavior is represented by the acoustic energy exiting the front (solid line) and back dashed line) of the transducer 22 being substantially equal at varying frequencies. The off-axis acoustic energy is shown by the dotted line. The dipole bandwidth increases significantly (from a top end of ~2 kHz to ~4 kHz) by just removing the mesh on the back. These measurements were taken at 5 cm from the driver and hold true for what the feedforward microphone 20 sees.

Figure 7A:
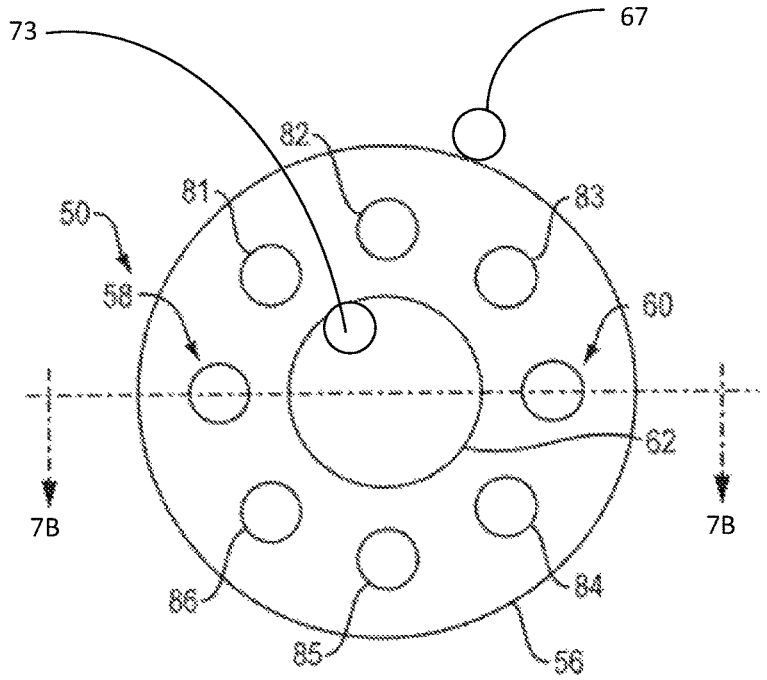
FIG. 7A is a bottom view of an audio unit for a headphone.
Figure 7B:
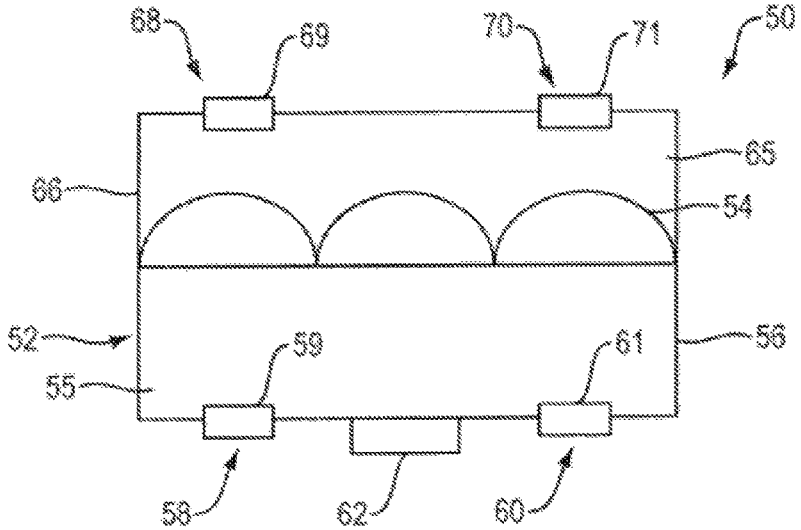
FIG. 7B is a cross-sectional view taken along line 7B-7B of FIG. 7A.

FIGS. 7A and 7B show another example with an audio unit 50 that can be used in a headphone. Audio unit 50 includes a driver (or transducer) 52 that includes diaphragm/surround 54, magnet/coil assembly 62 and structure or basket 56. Rear acoustic chamber 55 is located behind diaphragm 54. Openings 58, 60 and 81-86 are formed in the rear side of basket 56. There can be one or more such openings. The area of each opening, and the area of the openings in total, is selected to achieve a desired acoustic impedance at the rear of the driver. The openings may also comprise tubes, and the length of each tube may be selected to achieve a desired acoustic impedance at the rear of the driver. In non-limiting examples acoustic resistance material 59 is located in or over opening 58 and acoustic resistance material 61 is located in or over opening 60. Typically but not necessarily each of the openings is covered by an acoustic resistance material, so as to develop a particular acoustic impedance at the rear of the driver.

In one example the acoustic impedances at the rear and the front of the driver are approximately the same to achieve a wider bandwidth of far-field cancellation. This can be accomplished by including a second basket or structure 66 located in front of and surrounding diaphragm/surround 54 such that acoustic chamber 65 is formed in the front of the driver. Basket 66 can be but need not be the same as basket 56, and can include the same openings and the same acoustic resistance material in the openings, so as to create the same acoustic impedances in the front and rear of the driver. A feed forward microphone 67 is secured to the periphery of one or both of the baskets 56 and 66 in a broadband acoustic null of the transducer 52. A feedback microphone 73 is secured to the transducer 52. Openings 68 and 70 filled with acoustic resistance material 69 and 71 are shown, to schematically illustrate this aspect. The acoustic resistance material helps to control a desired acoustic impedance to achieve a dipole pattern at low frequencies and a higher-order directional pattern at high frequencies. However, the increased impedance may result in decreased low frequency output.

A number of implementations have been described. Nevertheless, it will be understood that additional modifications may be made without departing from the scope of the inventive concepts described herein, and, accordingly, other embodiments are within the scope of the following claims.

What is claimed is:

1. A headphone, comprising:

an electroacoustic transducer;

a support structure for suspending the transducer adjacent to a user's ear when worn by the user such that the headphone is acoustically open;

a first microphone coupled to at least one of the transducer and the support structure such that the first microphone is located in a substantially broadband acoustic null of the transducer; and a processor coupled to the headphone, wherein the microphone receives sound pressure waves and outputs a related electronic signal to the processor, and wherein the processor uses the electronic signal to operate the transducer to reduce targeted sound pressure waves at the user's ear.

2. The headphone of claim 1, further including a second microphone coupled to at least one of the transducer and the support structure, the second microphone being a feedback microphone located between the transducer and the user's ear, wherein the second microphone receives sound pressure waves and outputs a related electronic signal to the processor, and wherein the processor uses these electronic signal to operate the transducer to reduce targeted sound pressure waves at the user's ear.

3. The headphone of claim 1, wherein the first microphone is located substantially at a periphery of a basket of the transducer.

4. The headphone of claim 1, further including one or more additional microphones which are also coupled to at least one of the transducer and the support structure such that the one or more additional microphones are also located in a substantially broadband acoustic null of the transducer, wherein the one or more additional microphones receive sound pressure waves and output a related electronic signals to the processor, and wherein the processor uses these electronic signals to operate the transducer to reduce targeted sound pressure waves at the user's ear.

5. The headphone of claim 1, wherein the processor discontinues using the electronic signal to operate the transducer to reduce targeted sound pressure waves at the user's ear when a noise level in a vicinity of the headphone drops below a certain level.

6. The headphone of claim 1, wherein acoustic impedances at a rear and front of the electroacoustic transducer are substantially the same.

7. The headphone of claim 1, further including a pair of baskets which surround a diaphragm of the electroacoustic transducer, each basket having one or more openings such that acoustic impedances at a rear and front of the electroacoustic transducer are substantially the same.

8. A headphone, comprising:

an electroacoustic transducer;

a support structure for suspending the transducer adjacent to a user's ear when worn by the user such that the headphone is acoustically open;

a first microphone coupled to at least one of the transducer and the support structure; and a processor coupled to the headphone, wherein the microphone receives sound pressure waves and outputs a related electronic signal to the processor, the processor uses the electronic signal to operate the transducer to reduce targeted sound pressure waves at the user's ear.

9. The headphone of claim 8, wherein the first microphone is a feed-forward microphone.

10. The headphone of claim 9, wherein the first microphone is located in a substantially broadband acoustic null of the transducer.

11. The headphone of claim 9, wherein the first microphone is located substantially at a periphery of a basket of the transducer.

12. The headphone of claim 9, further including a feedback microphone which outputs electronic signals to the processor.

13. The headphone of claim 9, wherein the processor discontinues using the electronic signal to operate the transducer to reduce targeted sound pressure waves at the user's ear when a noise level in a vicinity of the headphone drops below a certain level.

14. The headphone of claim 8, wherein the first microphone is a feedback microphone which outputs electronic signals to the processor.

15. An apparatus for creating sound, comprising:

an electroacoustic transducer;

a first microphone coupled to the transducer such that the first microphone is located in a substantially broadband acoustic null of the transducer; and a processor coupled to the microphone, wherein the microphone receives sound pressure waves and outputs a related electronic signal to the processor, and wherein the processor uses the electronic signal to operate the transducer to reduce targeted sound pressure waves at a user's ear.

16. The apparatus of claim 15, a second microphone coupled to the transducer, the second microphone being a feedback microphone located between the transducer and a user's ear, wherein the second microphone receives sound pressure waves and outputs a related electronic signal to the processor, and wherein the processor uses these electronic signal to operate the transducer to reduce targeted sound pressure waves at the user's ear.

17. The apparatus of claim 15, wherein the first microphone is located substantially at a periphery of a basket of the transducer.

18. The headphone of claim 15, further including one or more additional microphones which are also coupled to the transducer such that the one or more additional microphones are also located in a substantially broadband acoustic null of the transducer, wherein the one or more additional microphones receive sound pressure waves and output a related electronic signals to the processor, and wherein the processor uses these electronic signals to operate the transducer to reduce targeted sound pressure waves at a user's ear.

19. The headphone of claim 15, wherein the processor discontinues using the electronic signal to operate the transducer to reduce targeted sound pressure waves at the user's ear when a noise level in a vicinity of the headphone drops below a certain level.

20. The headphone of claim 15, wherein acoustic impedances at a rear and front of the electroacoustic transducer are substantially the same.

* * * * *